US011240604B2

(12) United States Patent
Huang et al.

(10) Patent No.: US 11,240,604 B2
(45) Date of Patent: Feb. 1, 2022

(54) PLANAR SPEAKER WITH DAMPING TO REDUCE NOISE

(71) Applicant: Dell Products L. P., Round Rock, TX (US)

(72) Inventors: Chien Yu Huang, New Taipei (TW); Cola Hung Shih, Taipei (TW)

(73) Assignee: Dell Products L.P., Round Rock, TX (US)

( * ) Notice: Subject to any disclaimer, the term of this patent is extended or adjusted under 35 U.S.C. 154(b) by 0 days.

(21) Appl. No.: 16/832,491

(22) Filed: Mar. 27, 2020

(65) Prior Publication Data

US 2021/0306756 A1 Sep. 30, 2021

(51) Int. Cl.
*H04R 7/26* (2006.01)

(52) U.S. Cl.
CPC ..... *H04R 7/26* (2013.01)

(58) Field of Classification Search
CPC ..... H04R 7/26
See application file for complete search history.

(56) References Cited

U.S. PATENT DOCUMENTS

| | | | | |
|---|---|---|---|---|
| 3,496,307 | A * | 2/1970 | Sotome | H04R 9/06 381/420 |
| 10,078,097 | B2 * | 9/2018 | Dubbeldeman | G10K 11/002 |
| 10,321,235 | B2 * | 6/2019 | Salvatti | H04R 1/06 |
| 2020/0053467 | A1 * | 2/2020 | Sato | H04R 7/18 |

* cited by examiner

*Primary Examiner* — Brian Ensey
(74) *Attorney, Agent, or Firm* — Larson Newman, LLP

(57) ABSTRACT

In some examples, a computing device may include one or more planar speakers. Individual planar speakers may include damping material adhered to either a top surface of a front pole or a bottom surface of a cone. The damping material may reduce a noise caused by the cone hitting the front pole (e.g., when reproducing loud passages in media content) to an inaudible (e.g., 30 db or less) level. The noise may be reduced by up to 35 decibels between about 250 Hertz to about 450 Hertz. The damping material may comprise a polyurethane foam and may have a height of between about 0.1 millimeters to about 1.0 millimeters and preferably about 0.2 millimeters.

17 Claims, 7 Drawing Sheets

PLANAR SPEAKER WITH DAMPING TO REDUCE NOISE

BACKGROUND OF THE INVENTION

Field of the Invention

This invention relates generally to speakers used in computing devices and, more particularly, to using damping material to reduce noise caused when the speaker cone touches a front pole (or another portion) of the speaker mechanism.

Description of the Related Art

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Speakers used in portable computing devices, such as smartphones, tablets, laptops, notebooks, and the like, may have a relatively shallow speaker cone to accommodate the thin form factor desired by users. However, when playing media content (e.g., audio files or video files) that has audio content with a high dynamic range, such a speaker cone may intermittently hit a front pole of the speaker, generating an audible noise that is unpleasant to listen to, causing users to complain about poor audio quality. One solution to reduce such audible noise is to reduce the volume when content with a high dynamic range is played. Another solution is to reduce the level of certain frequencies that may cause the speaker cone to hit the front pole. However, such solutions adversely affect the user's listening experience. A third solution is to use a secondary suspension between the voice coil and yoke. However, adding a secondary suspension reduces the speaker's low frequency output and power handling and increases manufacturing costs.

SUMMARY OF THE INVENTION

This Summary provides a simplified form of concepts that are further described below in the Detailed Description. This Summary is not intended to identify key or essential features and should therefore not be used for determining or limiting the scope of the claimed subject matter.

In some examples, a computing device may include one or more planar speakers. Individual planar speakers may include damping material adhered to either a top surface of a front pole or a bottom surface of a cone. The damping material may reduce a noise caused by the cone hitting the front pole (e.g., when reproducing loud passages in media content) to an inaudible (e.g., 30 db or less) level. The noise may be reduced by up to 35 decibels between about 250 Hertz to about 450 Hertz. The damping material may comprise a polyurethane foam and may have a height of between about 0.1 millimeters to about 1.0 millimeters and preferably about 0.2 millimeters.

BRIEF DESCRIPTION OF THE DRAWINGS

A more complete understanding of the present disclosure may be obtained by reference to the following Detailed Description when taken in conjunction with the accompanying Drawings. In the figures, the left-most digit(s) of a reference number identifies the figure in which the reference number first appears. The same reference numbers in different figures indicate similar or identical items.

DETAILED DESCRIPTION

Figure 1:
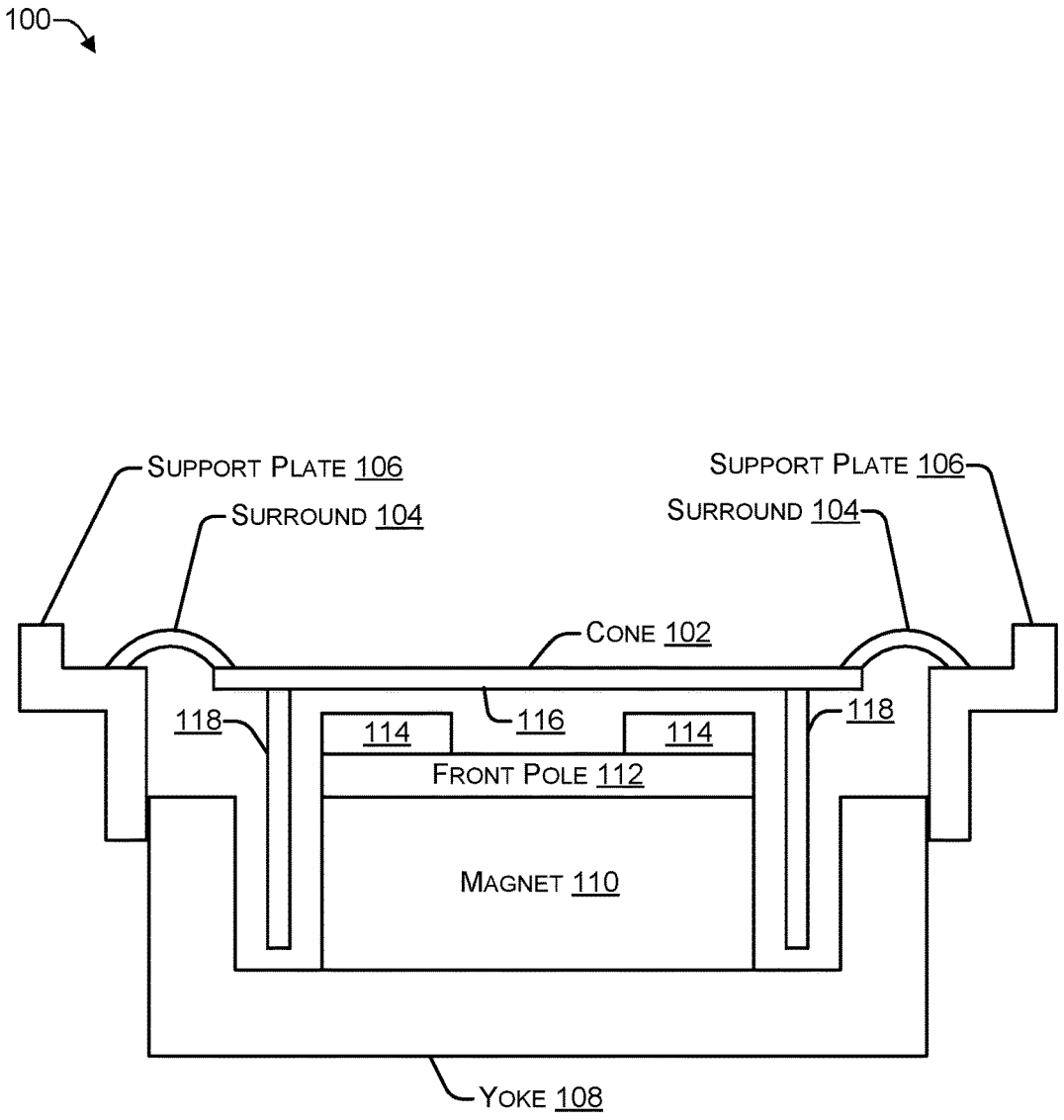
FIG. 1 is a diagram of a cutaway view of a speaker that includes damping material adhered to a front pole of the speaker, according to some embodiments.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or video display. The information handling system may also include one or more buses operable to transmit communications between the various hardware components.

The systems and techniques described herein place damping material on a portion of a top surface of pole of a speaker to reduce noise caused by the speaker cone when reproducing media content having a high dynamic range. The term dynamic range refers to the difference between the quietest and the loudest volume of an instrument, part or piece of music.

Planar-type speakers are often used in portable computing devices, such as smartphones, tablets, laptops, notebooks, and the like, because they are relatively small and do not use a very large enclosure volume. The small form factor of portable computing devices, particularly as the devices become thinner and thinner, is one of the main reasons that planar speakers are often used in portable computing devices. The term planar refers to speakers that have an approximately rectangular, relatively shallow, speaker cone. When playing media content with audio content that has a high dynamic range, the speaker cone may flex to such a degree that the speaker cone may intermittently hit a front pole of the speaker, generating an audible noise that is unpleasant to listen to, causing users to complain about poor audio quality. By placing a thin layer of damping material on those portions of the front pole with which the speaker cone may come in contact, such noise may be reduced to an inaudible (e.g., 30 decibels (db) or less) level.

By adding damping material between the speaker cone and the front pole, the speaker cone avoids being in direct contact with the front pole. For a planar speaker that includes the damping material, when the speaker cone flexes inwards, e.g., towards the front pole, the noise caused by the speaker cone hitting or rubbing against the front pole is reduced to an inaudible level when playing audio content with high dynamics. When the speaker cone flexes outward, the excursion of the speaker cone is not limited. Thus, by using the damping material, the excursion of the speaker cone may be asymmetrical. In this way, the volume (e.g., loudness) and total harmonic distortion (THD) are not significantly (e.g., audibly) affected by the damping material, even when playing audio content that with high dynamics. A speaker that uses the damping material results in a speaker with increased low frequency (e.g., bass) output and a higher power output (e.g., loudness) as compared to a speaker that does not use the damping material.

In some cases, the damping material may be adhered (e.g., using an adhesive during the manufacturing process) to a portion of the front pole of the speaker. In other cases, the damping material may be adhered (e.g., using an adhesive during the manufacturing process) to a portion of the rear surface of the cone of the speaker. Adding damping material to a speaker may not cause a significant (e.g., audible) change in the frequency response of the speaker. In addition, by adding damping material to a speaker, the speaker's power handling capacity may be increased. For example, a speaker that, without damping material, is rated at 2.0 watts root mean square (RMS) and 2.5 watts peak handling may be capable of handling 2.5 watts RMS and 3.0 watts peak with the damping material added.

As a first example, a planar speaker may include: (i) a cone, (ii) a surround attached to an outer edge of the cone, (iii) a magnet, (iv) a voice coil having multiple windings placed around the magnet and attached to a bottom of the cone, (v) a front pole mounted on a top surface of the magnet and below the cone, and (vi) damping material that is adhered to a top surface of the front pole. For example, playing back media content that causes the cone to move towards the front pole may cause a rear surface of the cone to come in contact with the damping material. The damping material reduces a sound caused by the cone touching the top surface of the front pole to about 30 decibels or less for frequencies from about 280 Hertz and above (e.g., to about 1000 Hertz). In some cases, the planar speaker has a length of 34 millimeters, an outer width of 13 millimeters, and a height of 2.7 millimeters, and the damping material has a length of 24.6 millimeters, an outer width of 4.6 millimeters, an inner width of between 1.3 millimeters to 1.5 millimeters. and a height (e.g., thickness) of between 0.1 mm and 1.0 mm and preferably 0.2 mm. The planar speaker may have: a length of one of 15, 16, 25, 32, 34, or 40 millimeters, a width of one of 8, 9, 11, or 13 millimeters, and a height of between about 1.0 mm to about 5.0 mm. For example, the height may be one of 2.0, 2.5, 3.0, 3.5, 4.0, or 4.5 millimeters. The damping material may comprise a polyurethane foam. The cone has an asymmetric excursion caused in part by the damping material. The cone comprises either wood or microcellular polyurethane (MCP), the surround comprises polyether ether ketone (PEEK), and the magnet comprises a neodymium magnet.

As a second example, a planar speaker may include: (i) a cone, (ii) a surround attached to an outer edge of the cone, (iii) a magnet, (iv) a voice coil having multiple windings that is placed around the magnet and attached to a bottom of the cone, (v) a front pole mounted on a top surface of the magnet and below the cone, and (vi) damping material that is adhered to a bottom surface of the cone. For example, playing back content that causes the cone to move towards the front pole may result in the damping material coming in contact with the front pole. The damping material may reduce a sound caused by the cone touching the top surface of the front pole to about 30 decibels or less for frequencies from about 280 Hertz and above. The planar speaker may have a length of about 34 millimeters, an outer width of about 13 millimeters, and a height of one of 2.0, 2.5, 3.0, 3.5, 4.0, or 4.5 millimeters. The damping material may have a length of about 24.6 millimeters, an outer width of about 4.6 millimeters, an inner width of between about 1.3 millimeters to about 1.5 millimeters and a height of about 0.2 millimeters. The damping material may comprise a polyurethane foam having a thickness of between about 0.1 millimeters to about 1.0 millimeters and preferably about 0.2 mm. The damping material may cause the cone to have an asymmetric excursion. The cone may be comprised of either wood or microcellular polyurethane (MCP), the surround may be comprised of polyether ether ketone (PEEK), and the magnet may be comprised of a neodymium magnet.

As a third example, a computing device includes: one or more processors, one or more non-transitory computer-readable storage media to store: (i) instructions that are executable by the one or more processors and (ii) media content, and at least one planar speaker. The at least one planar speaker may include: (i) a cone, (ii) a surround attached to an outer edge of the cone, (iii) a magnet, (iv) a voice coil having multiple windings placed around the magnet, the voice coil attached to a bottom of the cone, (v) a front pole mounted on a top surface of the magnet and below the cone, and (vi) damping material that is located between a rear surface of the cone and a top surface of the front pole. For example, playing back the media content using the planar speaker may cause the cone to move towards the front pole. The damping material may reduce a noise caused by the rear surface of the cone contacting the top surface of the front pole. The damping material may reduce the noise caused by the rear surface of the cone contacting the top surface of the front pole by up to about 35 decibels for frequencies between about 250 Hertz to about 450 Hertz. The planar speaker may have a length of 34 millimeters, an outer width of 13 millimeters, and a height of one of 2.0, 2.5, 3.0, 3.5, 4.0, or 4.5 millimeters. The damping material may have a length of 24.6 millimeters, an outer width of 4.6 millimeters, and a height of 0.2 millimeters. The planar speaker may have: a length of between about 15 to about 40 millimeters, a width of between about 8 to about 13 millimeters, and a height of between about 2.5 to about 4.5 millimeters. The damping material may comprise a polyurethane foam having a thickness of between about 0.1 millimeters to about 1.0 millimeters, and preferably about 0.2 mm. The damping material may cause the cone to have an asymmetric excursion. The cone may comprise either wood or microcellular foam plastic (MCP), the surround may comprise polyether ether ketone (PEEK), and the magnet may comprise a neodymium magnet.

FIG. 1 is a diagram of a cutaway view of a speaker 100 that includes damping material adhered to a front pole of the speaker, according to some embodiments. The speaker 100 may include a cone 102. The cone 102 may include paper, metal, plastic (e.g., polypropylene), aramid fiber, Kevlar, wood (e.g., bamboo), or any combination thereof. A surround 104 may be attached to the cone 102 and to a support plate 106. The surround 104 may include (i) butyl rubber or (ii) preferably polyether ether ketone (PEEK), an organic thermoplastic polymer (e.g., a type of polyaryletherketone). The support plate 106 may include acrylonitrile butadiene styrene (ABS), polycarbonate (PC), or any combination thereof. The support plate 106 may be attached to a yoke 108. The yoke 108 may include a type of steel, such as low carbon steel (e.g., steel that has a low ratio of carbon to iron, typically less than 0.30% carbon). A permanent magnet 110 may be located inside the yoke 108. The permanent magnet 110 may include (i) alnico (e.g., a combination of aluminum, nickel and cobalt), (ii) ceramic (e.g., a combination of iron oxide (ferrite) and strontium carbonate), or (iii) preferably neodymium. A front pole 112 may be located on top of the magnet 110. The front pole 112 may include a type of steel, such as low carbon steel.

Damping material 114 may be attached, using an adhesive (e.g., during manufacturing), to a portion of a surface of the front pole 112 that faces a rear surface 116 of the cone 102. The damping material 114 may be a type of foam, such as polyurethane foam. In some cases, the polyurethane foam may be an open-cell foam while in other cases the polyurethane foam may be a closed-cell foam. A voice coil 118 may be placed around the magnet 110. The voice coil 118 may include copper (or a copper alloy based) wire.

Media content (e.g., audio content, video content) may be stored on a computing device in the form of a digital file. Alternately, media content stored on a remote server may be streamed across one or more networks for playback on the computing device. When a user initiates playback of a digital file, the digital audio in the media content is converted (e.g., using a digital-to-analog converter (DAC)) to an analog audio signal. The analog audio signal is provided, via wires, to the voice coil 118. The analog audio signal (e.g., an electrical signal) induces a magnetic field in the voice coil 118, causing the voice coil 118 to move relative to the permanent magnet 110. Thus, when the analog audio signal passes through the voice coil 118, the voice coil 118 becomes an electromagnet that has a magnetic field that interacts with the magnetic field of the permanent magnet 110. This interaction between the voice coil 118 and the permanent magnet 110 causes the cone 102, that is attached to the voice coil 118, to move up and down, resulting in the cone 102 creating pressure waves in the air that are perceived as sound. In this way, the movement of the cone 102, caused by the audio signal in the voice coil 118, results in changes to the air pressure that creates sound waves. The faster the air pressure changes, the higher the frequency of the sound waves.

As the cone 102 moves back and forth, the cone 102 of a conventional speaker (e.g., that does not include the damping material 114) may briefly and repeatedly touch the front pole 112, causing an unwanted rubbing sound, particularly when playing content that has a high dynamic range. For example, the louder passages of media content may cause the cone 102 to move further in order to move more air to create the louder sounds and this movement may result in the cone 102 touching the front pole 112, if the damping material 114 is absent. By placing the damping material 114 between the rear 116 of the cone 102 and the front pole 112, the louder passages of media content may cause the cone 102 to come in contact with and compress the damping material rather than touching the front pole 112. Thus, when the cone 102 travels down (e.g., towards the front pole 112), the damping material 114 may reduce, to an inaudible level (e.g., 30 decibels (db) or less), the noise caused by the cone 102 touching the front pole 112. In addition, the damping material 114 may result in the cone 102 having an asymmetrical excursion. Excursion is a distance that the cone 102 linearly travels from a resting position (e.g., when no audio signal is present). The cone 102 may travel a first distance D1 when the cone 102 moves away from the front pole 112 and may travel a second distance D2 when the cone 102 moves towards the front pole 112. The damping material 114 may include a foam that compresses when the cone 102 comes in contact with the damping material 114. Therefore, the second distance D2 may be less than the first distance D1, resulting in an asymmetrical excursion.

Thus, by adding damping material between a rear surface of a cone and a front pole of a speaker, the noise produced when the cone repeatedly hits the front pole when playing loud passages in music may be reduced to an inaudible level, resulting in a more pleasing listening experience for the listener(s). Adding damping material may not cause a significant (e.g., audible) change in the frequency response of the speaker. In addition, by adding damping material to a speaker, the speaker's power handling capacity may be increased. For example, a speaker that, without damping material, is rated at 2.0 watts root mean square (RMS) and 2.5 watts peak handling may be capable of 2.5 watts RMS and 3.0 watts peak handling with the damping material added. While the systems and techniques described herein use a speaker built in to a computing device (e.g., smartphone, tablet, laptop, and the like) as an example, the systems and techniques may also be applied to standalone (e.g., external) speakers. In addition, while the systems and techniques described herein use a planar speaker as an example, the systems and techniques may also be used with speakers having other shapes (e.g., circular, oval, and the like) to reduce noise caused by the cone touching the front pole when reproducing loud portions of media content.

Figure 2:
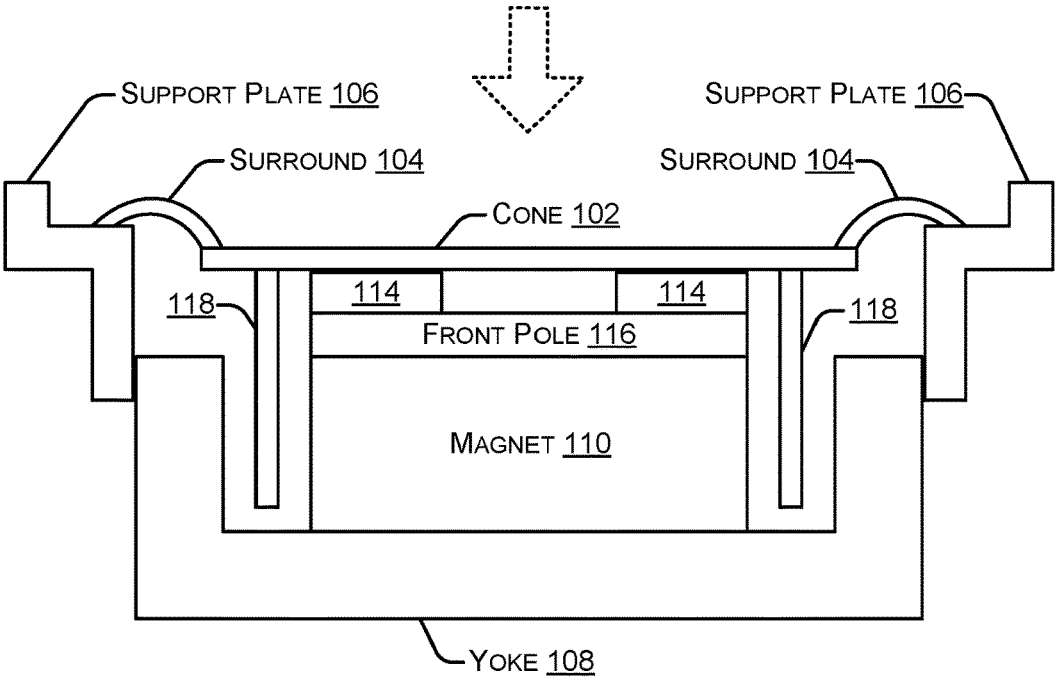
FIG. 2 is a diagram of a cutaway view of a speaker that includes damping material adhered to a front pole of the speaker when playing media content, according to some embodiments.

FIG. 2 is a diagram 200 of a cutaway view of a speaker that includes damping material adhered to a front pole of the speaker when playing media content, according to some embodiments. FIG. 2 illustrates how the cone 102 may appear when the cone 102 moves towards the front pole 116 and comes in contact with the damping material 114. As the cone 102 continues to move towards the front pole 116, the cone 102 may, after coming in contact with the damping material 114, compress the damping material 114.

Figure 3:
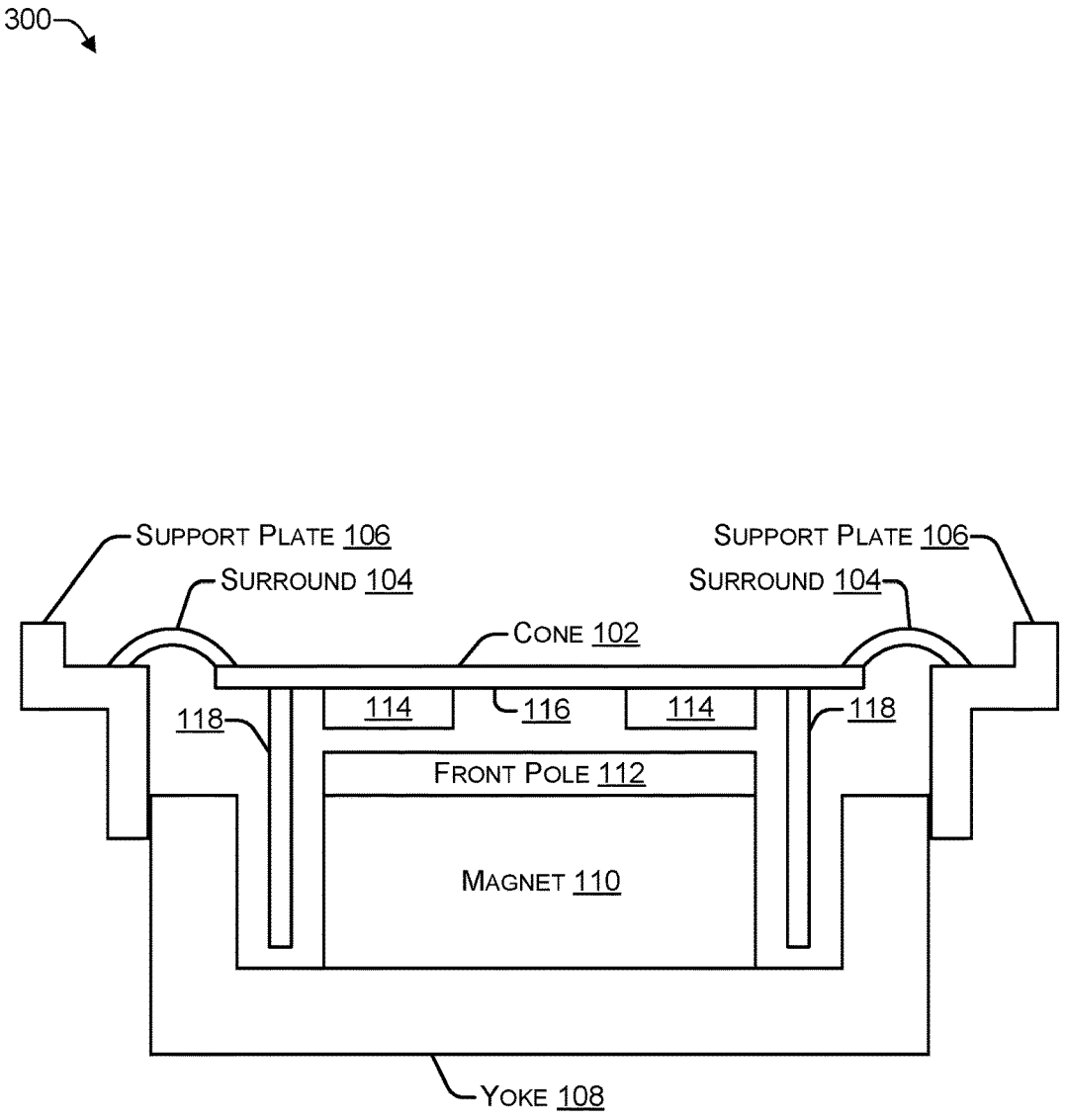
FIG. 3 is a diagram of a cutaway view of a speaker that includes damping material adhered to a rear surface of a cone of the speaker, according to some embodiments.
Figure 4:
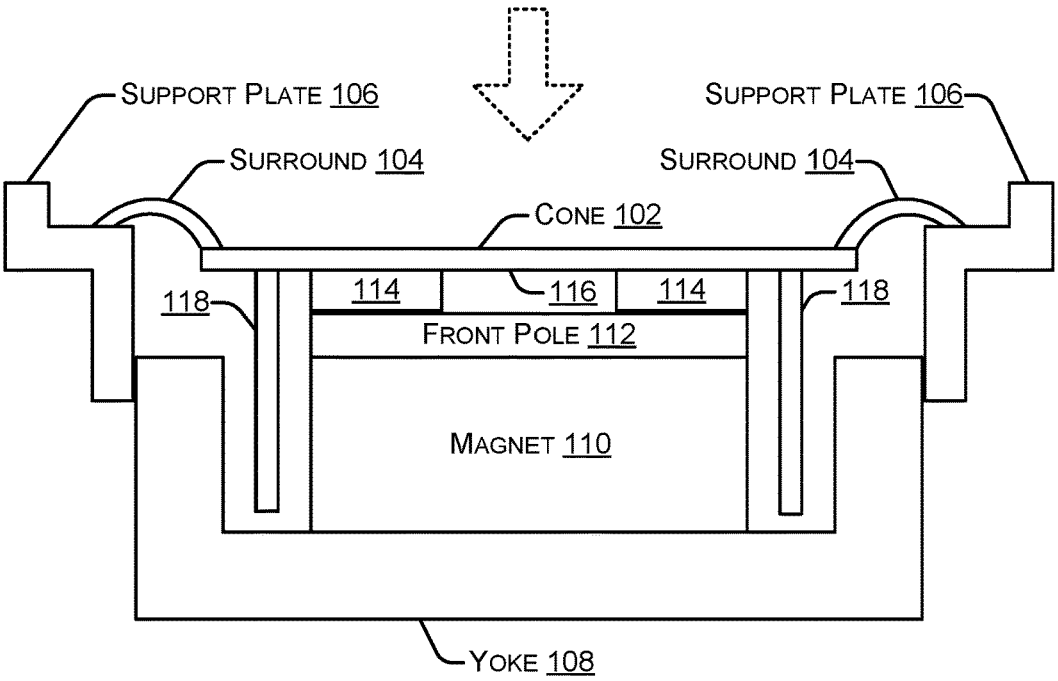
FIG. 4 is a diagram of a cutaway view of a speaker that includes damping material adhered to a rear surface of a cone of the speaker when playing media content, according to some embodiments.

FIGS. 1 and 2 illustrate a first embodiment in which the damping material 114 is adhered, during manufacturing, to a top (e.g., exposed) surface of the front pole 116. FIGS. 3 and 4 illustrate a second embodiment in which the damping material 114 is adhered, during manufacturing, to the bottom surface 116 of the cone 102. Adhering the damping material 114 to the cone 102 rather than the front pole 112 results in a slightly heavier cone 102, which means that more power may be used to move the cone 102 in the second embodiment as compared to the first embodiment. Thus, the second embodiment may be used with a product that features a higher output amplifier.

FIG. 3 is a diagram 300 of a cutaway view of a speaker that includes damping material adhered to a rear surface of a cone of the speaker, according to some embodiments. Damping material 114 may be attached, using an adhesive (e.g., during manufacturing), to a portion of the rear surface 116 of the cone 102. The damping material 114 may be a type of foam, such as polyurethane foam.

When a user initiates playback of a digital file, the digital audio in the media content is converted (e.g., using a DAC) to an analog audio signal. The analog audio signal is provided, via wires, to the voice coil 118. The analog audio signal (e.g., an electrical signal) induces a magnetic field in the voice coil 118, causing the voice coil 118 to move relative to the permanent magnet 110.

By placing the damping material 114 between the rear 116 of the cone 102 and the front pole 112, the louder passages of media content may cause the damping material 114 to come in contact with the front pole 112 and become compressed, preventing the cone 102 from touching the front pole 112. Thus, when the cone 102 travels down (e.g., towards the front pole 112), the damping material 114 may reduce, to an inaudible level (e.g., 30 db or less), the noise caused by the cone 102 touching the front pole 112. In addition, the damping material 114 may result in the cone 102 having an asymmetrical excursion. The cone 102 may travel a first distance D1 when the cone 102 moves away from the front pole 112 and may travel a second distance D2 when the cone 102 moves towards the front pole 112. The damping material 114 may touch the front pole 112 and compress when the cone 102 travels towards the front pole 112. Therefore, the second distance D2 may be less than the first distance D1, resulting in an asymmetrical excursion.

Thus, by adding damping material between a rear surface of a cone and a front pole of a speaker, the noise produced when the cone repeatedly hits the front pole when playing loud passages in music may be reduced to an inaudible level, resulting in a more pleasing listening experience for the listener(s). While the systems and techniques described herein use a speaker built in to a computing device (e.g., smartphone, tablet, laptop, and the like) as an example, the systems and techniques may also be applied to standalone (e.g., external) speakers. In addition, while the systems and techniques described herein use a planar speaker as an example, the systems and techniques may also be used with speakers having other shapes (e.g., circular, oval, and the like) to reduce noise caused by the cone touching the front pole when reproducing loud portions of media content.

FIG. 4 is a diagram 400 of a cutaway view of a speaker that includes damping material adhered to a rear surface of a cone of the speaker when playing media content, according to some embodiments. FIG. 4 illustrates how the cone 102 may appear when the cone 102 moves towards the front pole 116 and the damping material 114 comes in contact with the front pole 116. As the cone 102 continues to move towards the front pole 116, the damping material 114 may, after coming in contact with the front pole 116, become compressed.

Figure 5:
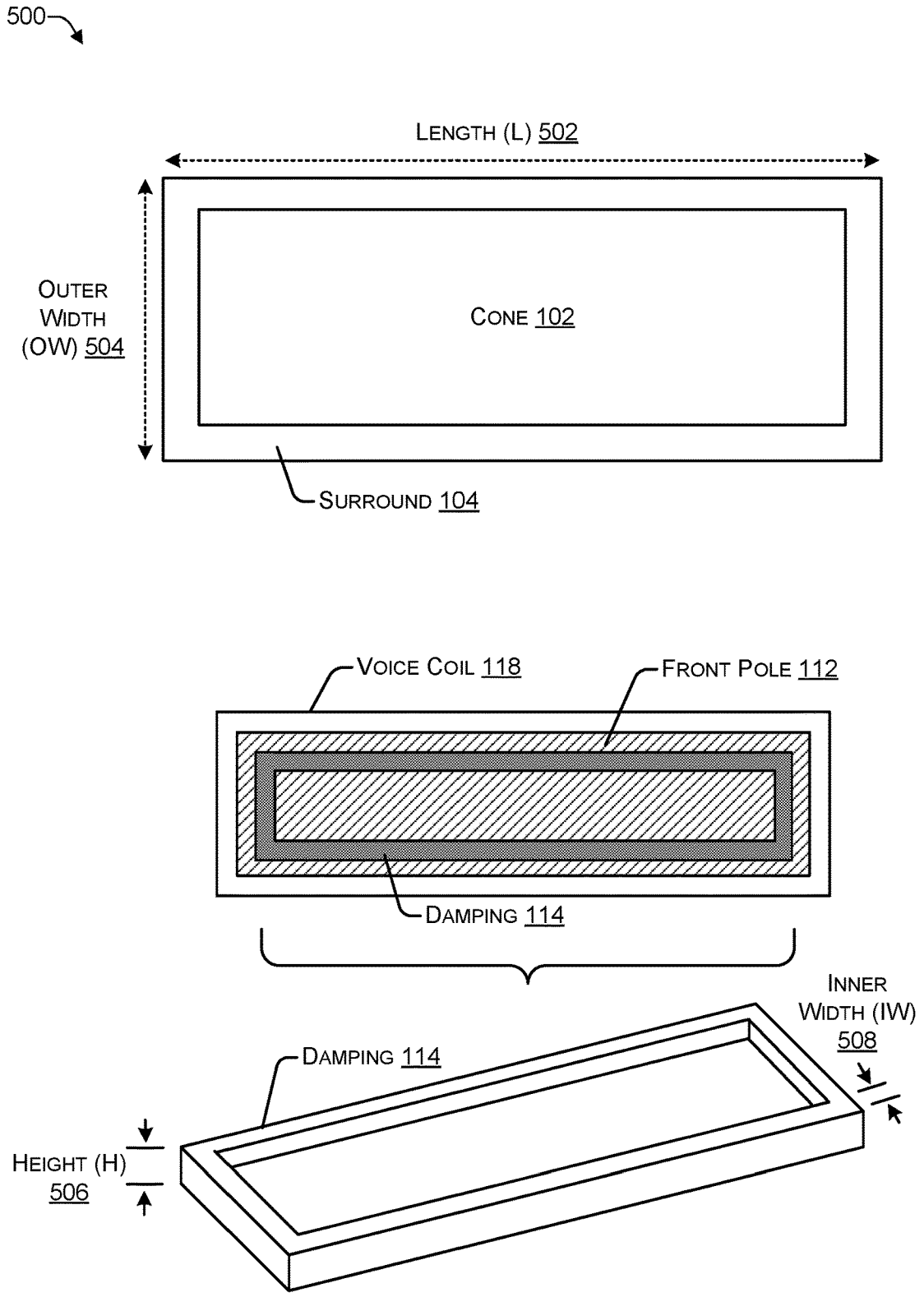
FIG. 5 is a diagram illustrating components of a planar speaker that includes damping material, according to some embodiments.

FIG. 5 is a diagram 500 illustrating components of a planar speaker that includes damping material, according to some embodiments. A planar speaker is typically used in portable computing devices, such as smartphones, tablets, laptops, notebooks, and the like, because a planar speaker is relatively small and does not use a very large enclosure volume. A planar speaker is a speaker that has an approximately rectangular, relatively shallow, cone 102.

The components of a planar speaker may include the cone 102, the surround 104, the front pole 112, and the voice coil 118 that is wrapped around the front pole 112. In FIG. 5, the damping material 114 is illustrated as being adhered on an outer edge of a top surface of the front pole 112. However, it should be understood that, in an alternate embodiment, the damping material 114 may be adhered on an outside edge of a bottom surface of the cone 102.

In the case of a planar speaker having a length 502 of 34 millimeters (mm), an outer width 504 of 13 mm, and a height 506 of 2.7 mm (e.g., sometimes expressed as 34 mm×13 mm×2.7 mm), the damping material 114 may have a length of about 24.6 mm, an outer width of about 4.6 mm, an inner width 508 of between about 1.3 mm to about 1.5 mm and a height of between about 0.1 mm to about 1.0 mm (and preferably about 0.2 mm).

Of course, the damping material 114 may be used with planar speakers having different dimensions than 34 mm×13 mm×2.7 mm. For example, the damping material 114 may be used with other sizes of planar speakers including, for example (L×OW×H): 15 mm×11 mm×2.5 mm, 15 mm×11 mm×3 mm, 16 mm×9 mm×2.5 mm, 16 mm×9 mm×3 mm, 25 mm×9 mm×3 mm, 25 mm×9 mm×2.5 mm, 32 mm×8 mm×3 mm, 32 mm×09 mm×3 mm, 32 mm×9 mm×3.5 mm, 34 mm×11 mm×4 mm, 40 mm×13 mm×4.5 mm, and the like.

The damping material may in some cases, be a single piece of material having a gasket-like shape (e.g., including a non-geometric shape or a geometric shape, such as a toroidal shape). In other cases, the damping material may include multiple pieces. The damping material may be adhered (i) along an outer portion of a top surface of a front pole of a speaker or (ii) along an outer portion of a rear surface of a cone of the speaker. The damping material may be fairly thin, e.g., between about 0.1 mm to about 1.0 mm, and preferably about 0.2 mm. The damping material may be made using a foam that compresses when the cone moves towards the front pole. The damping material may reduce the sound of the cone hitting the front pole when playing content with loud passages (e.g., high dynamic range) to an inaudible level (e.g., 30 db or less).

Figure 6:
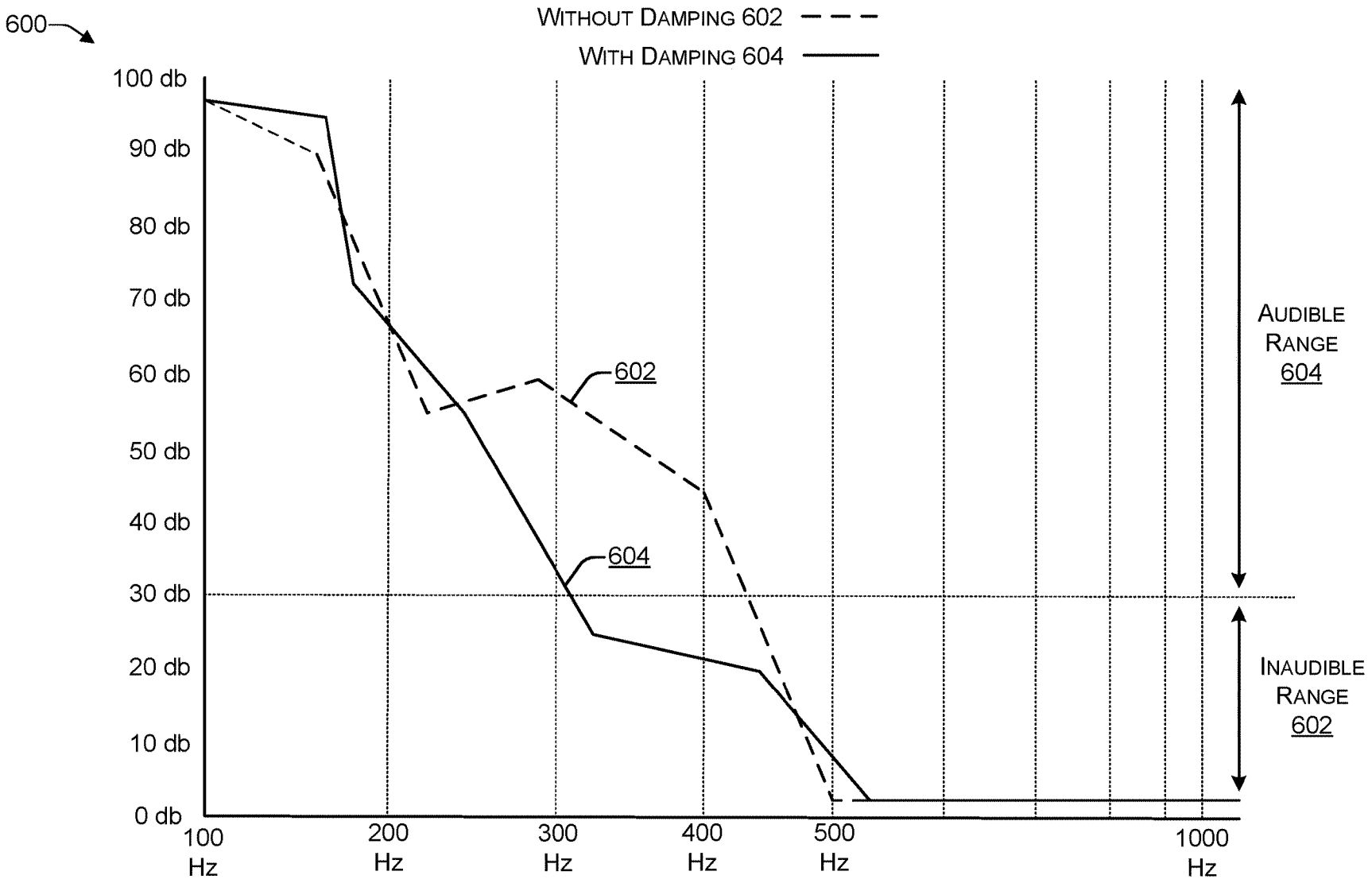
FIG. 6 is a diagram illustrating a first frequency response of a first speaker that does not include damping material and a second frequency response of a second speaker that includes the damping material, according to some embodiments.

FIG. 6 is a diagram 600 illustrating a first frequency response 602 of a first speaker that does not include damping material and a second frequency response 604 of a second speaker that includes the damping material, according to some embodiments. FIG. 6 illustrates how the noise caused by the cone hitting the front pole (as show in the first frequency response 602) may be reduced by up to approximately 35 db (as show in the first frequency response 604). The noise reduction begins at about 250 Hz and continues to about 450 Hz, with the largest noise reduction (e.g., up to about 35 Hz) occurring between about 280 Hz to about 420

Hz. A horizontal line is shown at 30 db as this is a level at which sounds are typically inaudible for most listeners. The addition of the damping material thus reduces noise to an inaudible level from about 280 Hz and higher.

Figure 7:
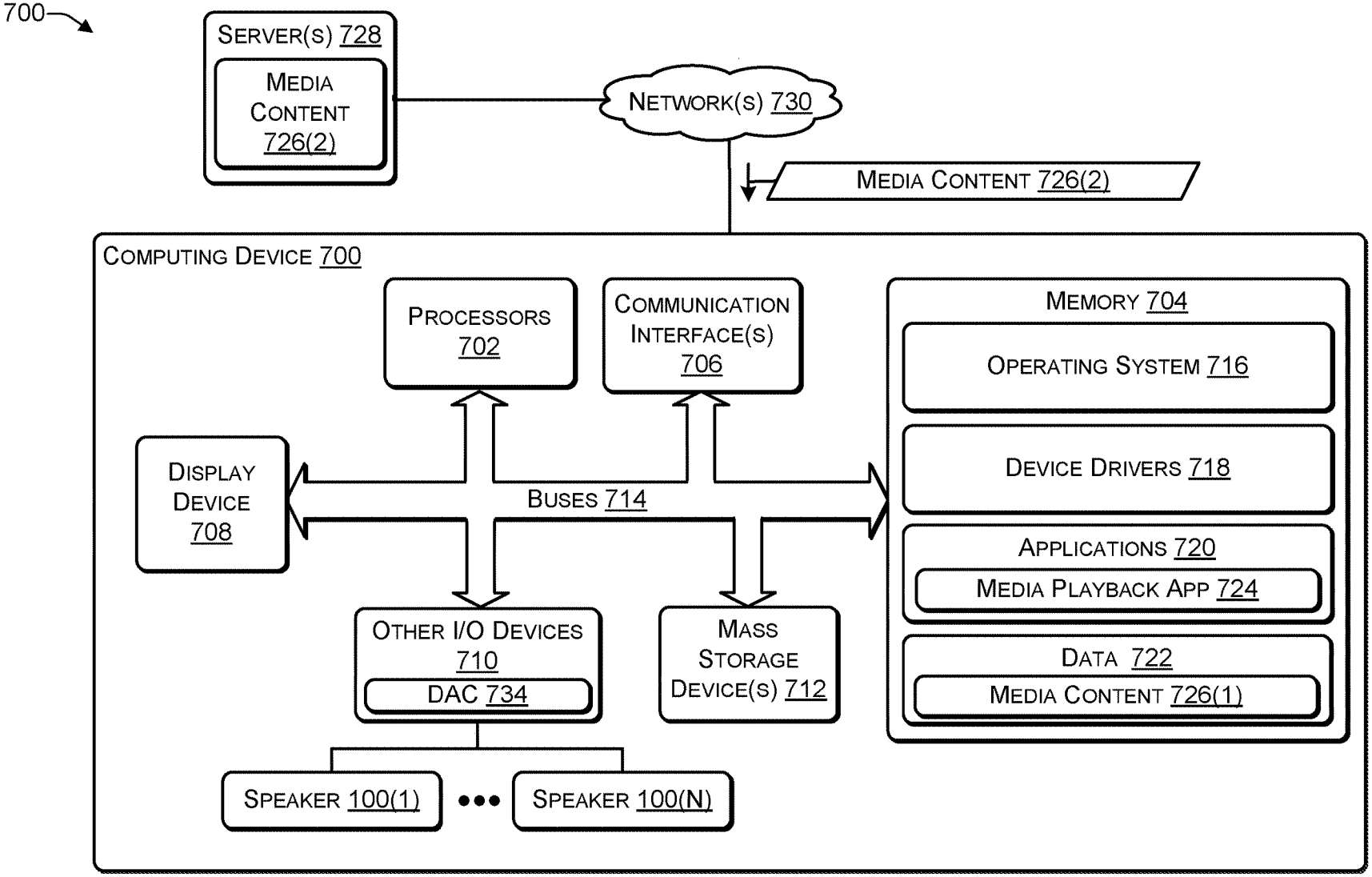
FIG. 7 illustrates an example configuration of a computing device that can be used to implement the systems and techniques described herein.

FIG. 7 illustrates an example configuration of a computing device 700 that can be used to implement the systems and techniques described herein. The computing device 100 may include processors 702, a memory 704, communication interfaces 706, a display device 708, other input/output (I/O) devices 710, and one or more mass storage devices 712, configured to communicate with each other, such as via system buses 714 or other suitable connections. While a single bus is illustrated in FIG. 7 for ease of understanding, it should be understood that the system buses 714 may include multiple buses, such as memory device buses, storage device buses, power buses, video signal buses, and the like.

The processors 702 (e.g., central processing unit (CPU), graphical processing unit (GPU), digital signal processor (DSP), and the like) are one or more hardware devices that may include one or more processing units, all of which may include single or multiple computing units or multiple cores. The processors 702 may be implemented as one or more microprocessors, microcomputers, microcontrollers, digital signal processors, central processing units, graphics processing units, state machines, logic circuitries, and/or any devices that manipulate signals based on operational instructions. Among other capabilities, the processors 702 may be hardware devices configured to fetch and execute computer-readable instructions stored in the memory 704, mass storage devices 712, or other computer-readable media.

Memory 704 and mass storage devices 712 are examples of computer storage media (e.g., memory storage devices) for storing instructions that can be executed by the processor 702 to perform the various functions described herein. For example, memory 704 may include both volatile memory and non-volatile memory (e.g., RAM, ROM, or the like) devices. Further, mass storage devices 712 may include hard disk drives, solid-state drives, removable media, including external and removable drives, memory cards, flash memory, floppy disks, optical disks (e.g., CD, DVD), a storage array, a network attached storage, a storage area network, or the like. Both memory 704 and mass storage devices 712 may be collectively referred to as memory or computer storage media herein, and may be a media capable of storing computer-readable, processor-executable program instructions as computer program code that can be executed by the processor 702 as a particular machine configured for carrying out the operations and functions described in the implementations herein.

The computing device 700 may also include one or more communication interfaces 706 for exchanging data via a network 730 with one or more servers, such as representative server 728. The communication interfaces 706 can facilitate communications within a wide variety of networks and protocol types, including wired networks (e.g., Ethernet, DOCSIS, DSL, Fiber, USB etc.) and wireless networks (e.g., WLAN, GSM, CDMA, 802.11, Bluetooth, Wireless USB, cellular, satellite, etc.), the Internet and the like. Communication interfaces 706 can also provide communication with external storage (not shown), such as in a storage array, network attached storage, storage area network, or the like. The display device 708, such as a monitor, may be connected to the computing device 700 in some implementations for displaying information and images to users. Other I/O devices 710 may include devices that receive various inputs from a user and provide various outputs to the user, and may include a keyboard, a remote controller, a mouse, a printer, audio input/output devices, and so forth. The other I/O devices 710 may include a digital-to-analog-converter (DAC) 734 to convert digital content to analog content. The analog content may be played back on speakers 100(1) to 100(N) (where N>0). For example, the computing device 700 may include two speakers (N=2) to provide stereo sound, three speakers (N=3) to provide stereo plus a central channel, or the like.

The computer storage media, such as memory 704 and mass storage devices 712, may be used to store software and data. For example, the computer storage media may be used to store an operating system 716, one or more device drivers 718, one or more applications 720, and data 722. The applications 720 may include a media playback application ("app") 724. The data 722 may include media content 726(1). The media playback app 724 may playback the media content 728 stored on the computing device 700 or stream, via the network(s) 730, media content 726(2) that is stored on the server 728.

The media content 726(1) (e.g., audio content, video content) may be stored on the computing device 700 in the form of digital files. Alternately or in addition, the media content 726(2) may be stored on the remote server 728 and may be streamed across one or more networks 730 for playback on the computing device 700. When a user initiates playback of the media content 726, the digital audio in the media content is converted using the DAC 734 to an analog audio signal. The analog audio signal is provided, via wires, to a voice coil of the speakers 100. The analog audio signal (e.g., an electrical signal) induces a magnetic field in the voice coil, causing the voice coil to move relative to a permanent magnet. Thus, when the analog audio signal passes through the voice coil, the voice coil becomes an electromagnet that has a magnetic field that interacts with the magnetic field of the permanent magnet. This interaction between the voice coil and the permanent magnet causes the cone, that is attached to the voice coil, to move up and down, resulting in the cone creating pressure waves in the air that are perceived as sound by the user(s).

The example systems and computing devices described herein are merely examples suitable for some implementations and are not intended to suggest any limitation as to the scope of use or functionality of the environments, architectures and frameworks that can implement the processes, components and features described herein. Thus, implementations herein are operational with numerous environments or architectures, and may be implemented in general purpose and special-purpose computing systems, or other devices having processing capability. Generally, any of the functions described with reference to the figures can be implemented using software, hardware (e.g., fixed logic circuitry) or a combination of these implementations. The term "module," "mechanism" or "component" as used herein generally represents software, hardware, or a combination of software and hardware that can be configured to implement prescribed functions. For instance, in the case of a software implementation, the term "module," "mechanism" or "component" can represent program code (and/or declarative-type instructions) that performs specified tasks or operations when executed on a processing device or devices (e.g., CPUs or processors). The program code can be stored in one or more computer-readable memory devices or other computer storage devices. Thus, the processes, components and modules described herein may be implemented by a computer program product.

Furthermore, this disclosure provides various example implementations, as described and as illustrated in the drawings. However, this disclosure is not limited to the implementations described and illustrated herein, but can extend to other implementations, as would be known or as would become known to those skilled in the art. Reference in the specification to "one implementation," "this implementation," "these implementations" or "some implementations" means that a particular feature, structure, or characteristic described is included in at least one implementation, and the appearances of these phrases in various places in the specification are not necessarily all referring to the same implementation.

Although the present invention has been described in connection with several embodiments, the invention is not intended to be limited to the specific forms set forth herein. On the contrary, it is intended to cover such alternatives, modifications, and equivalents as can be reasonably included within the scope of the invention as defined by the appended claims.

What is claimed is:

1. A planar speaker comprising:
a cone;
a surround attached to an outer edge of the cone;
a magnet;
a voice coil comprising multiple windings placed around the magnet, the voice coil attached to a bottom of the cone;
a front pole mounted on a top surface of the magnet and below the cone; and
damping material that is adhered to a top surface of the front pole;
wherein playing back content that causes the cone to move towards the front pole causes the rear surface of the cone to come in contact with the damping material, and wherein the cone has an asymmetric excursion caused in part by the damping material.

2. The planar speaker of claim 1, wherein:
the damping material reduces a sound caused by the cone touching the top surface of the front pole to about 30 decibels or less for frequencies from about 280 Hertz and above.

3. The planar speaker of claim 1, wherein:
the planar speaker has a length of 34 millimeters, an outer width of 13 millimeters, and a height of 2.7 millimeters; and
the damping material has a length of 24.6 millimeters, an outer width of 4.6 millimeters, an inner width of between 1.3 millimeters to 1.5 millimeters and a height of 0.2 millimeters.

4. The planar speaker of claim 1, wherein the planar speaker comprises:
a length of one of 15, 16, 25, 32, 34, or 40 millimeters;
a width of one of 8, 9, 11, or 13 millimeters; and
a height of one of 2.0, 2.5, 3.0, 3.5, 4.0, or 4.5 millimeters.

5. The planar speaker of claim 1, wherein:
the damping material comprises a polyurethane foam having a thickness of between about 0.1 millimeters to about 1.0 millimeters.

6. The planar speaker of claim 1, wherein:
the cone comprises either wood or microcellular foam plastic (MCP);
the surround comprises polyether ether ketone (PEEK); and
the magnet comprises a neodymium magnet.

7. A planar speaker comprising:
a cone;
a surround attached to an outer edge of the cone;
a magnet;
a voice coil comprising multiple windings placed around the magnet, the voice coil attached to a bottom of the cone;
a front pole mounted on a top surface of the magnet and below the cone; and
damping material that is adhered to a bottom surface of the cone;
wherein playing back content that causes the cone to move towards the front pole causes the damping material to come in contact with the front pole, and wherein the cone has an asymmetric excursion caused in part by the damping material.

8. The planar speaker of claim 7, wherein:
the damping material reduces a sound caused by the cone touching the top surface of the front pole to about 30 decibels or less for frequencies from about 280 Hertz and above.

9. The planar speaker of claim 7, wherein:
the planar speaker has a length of 34 millimeters, an outer width of 13 millimeters, and a height of one of 2.0, 2.5, 3.0, 3.5, 4.0, or 4.5 millimeters; and
the damping material has a length of 24.6 millimeters, an outer width of 4.6 millimeters, an inner width of between 1.3 millimeters to 1.5 millimeters and a height of 0.2 millimeters.

10. The planar speaker of claim 7, wherein:
the damping material comprises a polyurethane foam having a thickness of between about 0.1 millimeters to about 1.0 millimeters.

11. The planar speaker of claim 7, wherein:
the cone comprises either wood or microcellular polyurethane (MCP);
the surround comprises polyether ether ketone (PEEK); and
the magnet comprises a neodymium magnet.

12. A computing device comprising:
one or more processors;
one or more non-transitory computer-readable storage media to store instructions that are executable by the one or more processors and to store media content; and
a planar speaker comprising:
a cone;
a surround attached to an outer edge of the cone;
a magnet;
a voice coil comprising multiple windings placed around the magnet, the voice coil attached to a bottom of the cone;
a front pole mounted on a top surface of the magnet and below the cone; and
damping material that is located between a rear surface of the cone and a top surface of the front pole;
wherein:
playing back the media content using the planar speaker causes the cone to move towards the front pole; and
the damping material reduces a noise caused by the rear surface of the cone contacting the top surface of the front pole, causing the cone to have an asymmetric excursion.

13. The computing device of claim 12, wherein:
the damping material reduces the noise caused by the rear surface of the cone contacting the top surface of the front pole by up to about 35 decibels for frequencies between about 250 Hertz to about 450 Hertz.

14. The computing device of claim 12, wherein:

the planar speaker has a length of 34 millimeters, an outer width of 13 millimeters, and a height of one of 2.0, 2.5, 3.0, 3.5, 4.0, or 4.5 millimeters; and the damping material has a length of 24.6 millimeters, an outer width of 4.6 millimeters, and a height of 0.2 millimeters.

15. The computing device of claim 12, wherein the planar speaker comprises:

a length of between about 15 to about 40 millimeters;

a width of between about 8 to about 13 millimeters; and a height of between about 2.5 to about 4.5 millimeters.

16. The computing device of claim 12, wherein:

the damping material comprises a polyurethane foam having a thickness of between about 0.1 millimeters to about 1.0 millimeters.

17. The computing device of claim 12, wherein:

the cone comprises either wood or microcellular foam plastic (MCP);

the surround comprises polyether ether ketone (PEEK); and the magnet comprises a neodymium magnet.

* * * * *